United States Patent [19]

Wiebe

[11] 4,203,200

[45] May 20, 1980

[54] METHOD AND APPARATUS FOR MAKING AN ENCAPSULATED PLUG-IN BLADE FUSE

[76] Inventor: Gerald L. Wiebe, 18 W. 077 Williamsburg La., Villa Park, Ill. 60181

[21] Appl. No.: 957,137

[22] Filed: Nov. 2, 1978

Related U.S. Application Data

[63] Continuation-in-part of Ser. No. 922,151, Jul. 7, 1978, Pat. No. 4,164,726, which is a continuation-in-part of Ser. No. 820,555, Aug. 1, 1977, Pat. No. 4,164,725.

[51] Int. Cl.[2] ..... H01H 69/02

[52] U.S. Cl. ..... 29/623; 29/756; 113/116 P

[58] Field of Search ..... 29/623, 619, 621, 417, 29/414, 564.6, 756; 337/198, 251, 252, 253, 260, 261, 264, 214, 215, 236; 338/213, 274, 275, 329; 339/19, 147 R, 258 R; 113/116 P

[56] References Cited

U.S. PATENT DOCUMENTS

| | | | |
|---|---|---|---|
| 2,052,533 | 8/1936 | Pender | 338/275 |
| 3,493,915 | 2/1970 | Cox | 339/19 |
| 4,067,103 | 1/1978 | Ciesmier | 113/116 P |
| 4,099,320 | 7/1978 | Schmidt | 29/623 |
| 4,099,322 | 7/1978 | Tait | 29/623 |

*Primary Examiner*—Francis S. Husar
*Assistant Examiner*—Gene P. Crosby

[57] ABSTRACT

A method and apparatus for making an encapsulated, three-piece electrically conducting component, such as a fuse, are provided wherein a progressive stamping die is used to form a pair of spaced apart blades in a sheet stock of electrically conducting metal. Each blade has at one end a terminal portion connected to a carrier member formed from the strip and at the other end a pair of spaced-apart rear bearing members and a flexibly hinged front bearing tongue disposed between the rear bearing members. The rear bearing members have a cradle with a substantially concave cross section for receiving a conducting wire therein. In the die, the tongue is forced outwardly away from the rear bearing members to provide an opening between the distal end of the bearing tongue and the cradles of the rear bearing members. A continuous wire may be inserted into the blades. Then the force on the tongue is relieved to permit it to move back toward the rear bearing members to securely clamp the wire in the cradles. The wire is severed on each side of a pair of blades to form a three-piece structure with a wire segment extending across, and being clamped between, a pair of spaced-apart blades. A plurality of such three-piece conducting components, still connected to the carrier member, may be then placed in a suitable molding apparatus wherein each wire segment and portions of the pair of blades of each component is encapsulated with a unitary body of electrically insulating thermoplastic material.

20 Claims, 10 Drawing Figures

METHOD AND APPARATUS FOR MAKING AN ENCAPSULATED PLUG-IN BLADE FUSE

CROSS REFERENCES TO RELATED APPLICATIONS

This application is a continuation-in-part of Ser. No. 922,151, July 7, 1978; now U.S. Pat. No. 4,164,726 entitled "Encapsulated Plug-In Electrically Conducting Component" and also a continuation-in-part of Ser. No. 820,555, Aug. 1, 1977; now U.S. Pat. No. 4,164,725 entitled "Three-Piece Solderless Plug-In Electrically Conducting Component".

BACKGROUND OF THE INVENTION

The present invention relates in general to electrically conducting components and more particularly to the type of components which have projecting terminals extending from an encapsulating body and which may be engaged with female pressure clip connectors or plugged into female connectors which are commonly provided in elongate blocks of insulating material.

The present invention relates more specifically to an apparatus and method for making a miniature size fuse for use in protecting electrical circuits, and especially for use in protecting electrically operated components in automotive vehicles.

The apparatus and method of the present invention are specifically adapted for making the types of fuses described in the above-referenced U.S. Pat. No. 4,164,726 with respect to FIGS. 1 through 12A therein and described in the above-referenced U.S. Pat. No. 4,164,725 with respect to FIGS. 1 through 12 therein.

It would be desirable to provide an apparatus and method for making a fuse of the type suggested above with a separate wire fusible link. Preferably, the link should be easily, yet securely, maintained in electrical contact with the terminal-forming blades during fabrication without requiring a solder connection.

SUMMARY OF THE INVENTION

The present invention provides an apparatus and method for making an extremely simplified electrically conducting component structure. The component can be easily and efficiently manufactured. In the preferred embodiment, the component functions as a fuse and has a separate fusible link or wire mounted across two blades or terminal posts. The fusible wire is completely encapsulated in an insulating material and is thus protected from undesirable atmospheric contamination. The blades have a unique spring clip structure which accommodates fusible wires of varying diameters and which forms a solderless clamp-type connection to the fuse wire that is self-aligning and vibration resistant.

Specifically, a pair of terminal-forming blades are stamped from a suitable conducting material and are each provided on one end with a spring clip structure comprising a pair of spaced-apart rear bearing members and a flexibly hinged, arcuate front bearing tongue between the rear bearing members. Each of the rear bearing members has a cradle with a substantially V-shaped cross section for receiving a portion of a conducting fuse wire. To provide rigidity and permit the pair of rear bearing members to be held as one piece during assembly of the fuse, the bearing members may be integrally connected together by a wall portion outwardly of their cradles. The terminal-forming blades are spaced apart in generally parallel relationship and the fusible wire is aligned substantially perpendicular to each blade and is inserted into the spring clip of each blade. The front bearing tongue is allowed to press against the fuse wire and hold it in a clamping engagement within the cradle of each rear bearing member to provide a solderless, electrically conducting path from one of the blades through the fusible link to the other of the blades. The fuse wire and the spring clip portion of each of the blades is preferably encapsulated with a solid unitary body of electrically insulated material such as a transparent thermoplastic, with the external surfaces of the fuse wire and blade spring clip portions in intimate contact with the encapsulating material.

The structure of the fuse made in accordance with the present invention thus offers a number of advantages over the prior art described in the "Background of the Invention" of the above referenced U.S. Pat. Nos. 4,164,726 and 4,164,725. For example, the terminal-forming blades can be made of any suitable conducting material and the fuse wire can be made of another material. This allows the terminal-forming blades to be formed of a material that will provide appropriate strength and durability which will withstand the abuse of insertions into female pressure spring clip assemblies. Owing to the unique design of the spring clip structure itself, the same blade design can be used for a number of differently rated fuses wherein fuse wires of different diameters are required.

Since the fuse wire is not soldered to the spring clip structure of the blade, the possibility of a soldered joint being destroyed by vibration, bending loads, or current heating is eliminated. Further, encapsulation of the fuse wire and spring clip portions of the blades provides additional support for the fuse wire.

The encapsulating material, being in intimate contact with the surfaces of the fuse wire, functions as a heat sink and can be formed around the fuse wire in a generally cylindrical shape to provide a substantially symmetrical temperature gradient and consequent uniform heat transmission from the fuse wire through the encapsulating material. The fact that the temperature gradient can be made substantially uniform and the fact that the fuse wire is not exposed to ambient air makes it possible to design a fuse which will "blow" at the specified current rating independent of atmospheric conditions and with negligible variation from fuse to fuse.

The spring clip structure of the fuse permits a novel method to be used in fabrication of the fuse. A progressive stamping die can be used to form a continuous strip of metal pulled through the die. After the rear bearing members and tongue are formed on each blade, the tongue can be moved away from the rear bearing members in the cradle region by pushing against a portion of the tongue outwardly of the hinge point. A fuse wire is then inserted into the openings on each blade. The tongues are allowed to spring closed to clamp the wire securely in the cradles of the rear bearing members.

Each pair of blades connected by a fuse wire is an individual subassembly to be encapsulated to form a single fuse. The individual subassemblies are, preferably, still connected by remaining portions of the continuous strip of metal. A portion of the strip, containing a number of such subassemblies, is severed from the rest of the strip and placed in an appropriate mold. The proper portion of each individual subassembly is then encapsulated.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
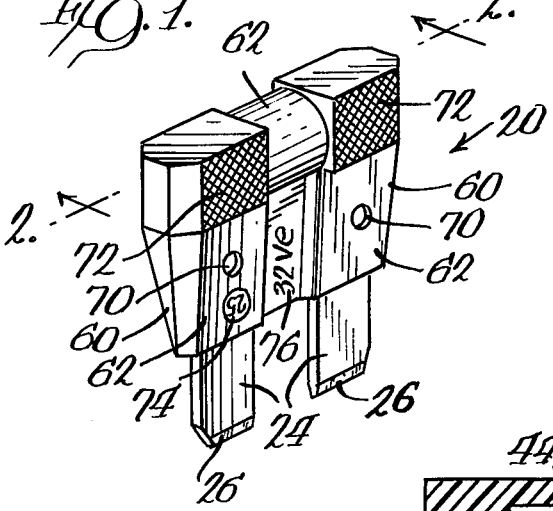
FIG. 1 is a perspective view of a fuse formed in accordance with the teachings of the present invention.

While the apparatus and method of this invention are susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

For ease of description, the fuse made by the apparatus and method of the present invention, as well as the apparatus, will be described in certain arbitrary orientations. Terms such as upper, lower, horizontal, etc., will be used with reference to these orientations. It will be understood, however, that the apparatus of this invention may be manufactured, stored, transported and sold in an orientation other than the orientation described and that the method of the invention may be effected in any orientation.

Referring now to the drawings, a plug-in electrically conducting component made by the method of the present invention is illustrated in a fuse shown in its entirety at 20 in FIG. 1, and includes a body 22 and a pair of terminals or terminal-forming blades or blades 24. Typically, the height of the fuse, from the top of the body 22 to the bottom end of the blades 24 is about $\mu$ inch. The width of the body 22 is about $\mu$ inch and the thickness of the body 22 is about 3/16 inch. The blades are typically 0.025 inch in thickness and may be spring brass, aluminum, or other suitable material.

The blades 24 are seen to project from the bottom of the body 22 and have tapered or pointed end portions 26 which readily slip into place between the confronting walls of a conventional female spring clip support in a mounting panel or fuse block (not shown). The three-piece solderless plug-in fuse element which is encapsulated in, and supported by, the body 22 will first be described in detail. Subsequently, the body 22 will be more fully described.

Figure 2:
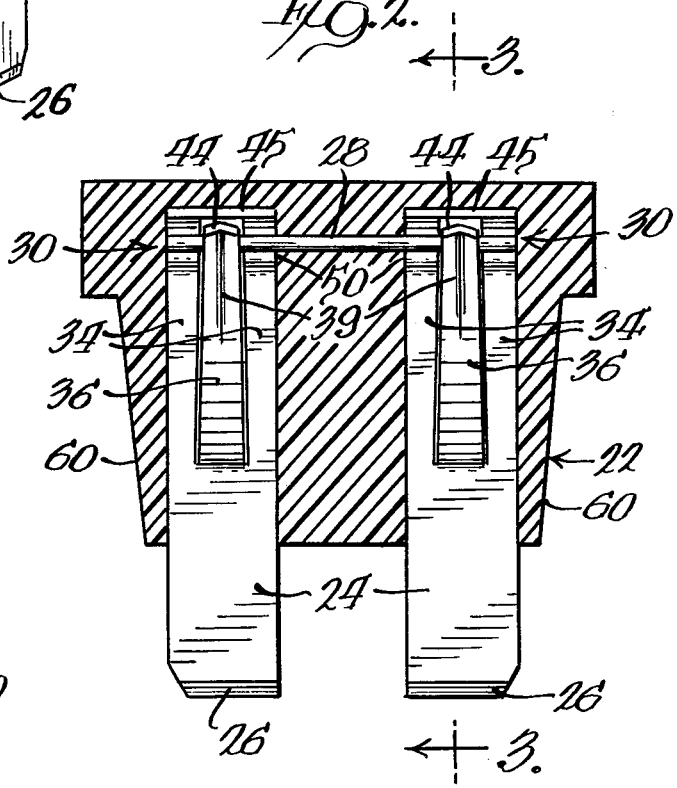
FIG. 2 is an enlarged cross-sectional view taken substantially along the plane 2—2 of FIG. 1.

With reference to FIG. 2, the three-piece fuse element is best illustrated as comprising the blades 24 and a fusible link, such as a substantially cylindrical fuse wire 28 connected between the pair of blades 24. Blades 24 are spaced apart in generally parallel relationship with the upper portions of the blades lying within the body 22. The fuse wire 28 is disposed substantially perpendicular to the blades 24 and a portion of the link 28 on each end is clamped by a novel spring clip structure 30 on the upper portion of each of the blades 24.

Figure 3:
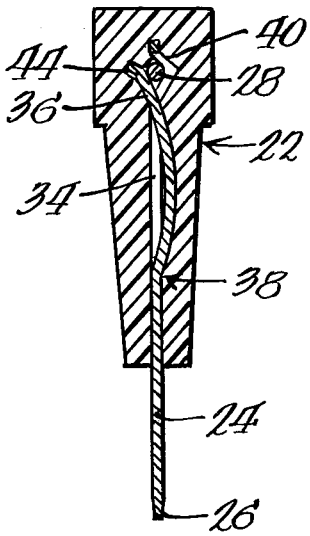
FIG. 3 is a cross-sectional view taken along the plane 3—3 of FIG. 2.

With reference to FIGS. 2 and 3, the spring clip structure of each blade 24 is seen to comprise a pair of spaced-apart rear bearing members 34 and a flexibly hinged front bearing tongue 36 between the rear bearing members 34.

One end of the tongue 36 is free to bend outwardly as illustrated in FIG. 3 and the other end of the tongue 36 is integrally connected with the blade 24 to form a flexible hinge as at 38. The tongue 36 may be angled or bent, as at bend line 39, to stiffen the tongue and provide more clearance between the rear bearing members 34 on either side of the tongue. To allow the fuse wire 28 to be easily inserted between the rear bearing members 34 and the flexibly hinged front bearing tongue 36, the tip 44 of the free end of the front bearing tongue 36 is angled outwardly away from the rear bearing members 34.

Each of the two rear bearing members 34 of the pair of rear bearing members 34 has a cradle 40 with a substantially V-shaped cross section for receiving a portion of the fuse wire 28 as is best illustrated in FIG. 3. To provide additional rigidity, and to better enable the rear bearing members to be held together at one time during insertion of a fuse wire between the rear bearing members 34 and the front bearing tongue 36, a connecting member or wall portion 45 is provided to interconnect the ends of the rear bearing members 34. The wall portion 45 may be a separate member secured on each end to the rear bearing member 34 or may be, as illustrated in FIG. 2, integrally stamped from the blades 24 so as to be continuous with the rear bearing members 34. Such a rigidifying member 45 is desirable with a three-piece solderless component of the present invention where the component is embedded in a fuse body which is formed by high pressure injection molding of an insulating material. Without a rigidifying member 45, the rear bearing members 34 may, under the impingement action of the high pressure injection material, be bent or displaced from the desired orientation.

The spring clip structure, comprising the rear bearing members 34 and the front bearing tongue 36 of each blade 24, may be cut or blanked from a single sheet of material. In particular, the front bearing tongue 36 and the rear bearing members 34 are initially formed by providing cuts 41 on each blade 24. Following the blanking operation, the particular cradle configuration 40, the slanted tip 44 of the front bearing tongue 36 and the arcuate shape of the front bearing tongue 36 may be subsequently stamped in a separate operation. Alternatively, both the blanking and the forming of the blank into the final configuration may be performed in one step. If desired, the blade can be blanked with the cuts 41 being slanted so that the width of the tongue decreases in width from a maximum at the flexible hinge to a minimum at the free end or tip 44.

The flexing action of the front bearing tongue 36 may be controlled to some extent by the shape of the curve of the tongue and the length of the tongue. Specifically, as illustrated in FIG. 3, the front bearing tongue may have a generally arcuate cross section for most of its length.

The tongue 36 may have other cross-sectional shapes, including a compound curve, such as the S-shaped cross section illustrated in FIG. 3 of each of the above-discussed U.S. Pat. Nos. 4,164,726 and 4,164,725. As will be explained in detail below, it has been found that the insertion of the fuse wire 28 into the spring clip structure is easily executed by the apparatus of the present invention if the tongue projects outwardly beyond the rear bearing members 34 on one side, though such a configuration is not necessary.

The front bearing tongue 36 is preferably formed into the arcuate cross section for another reason—to reduce its overall length with respect to its extension from the flexible hinge 38. That is, the front bearing tongue 36 is drawn downwardly towards the flexible hinge 38 so that the tongue becomes located between the increased width region between the two rear bearing members 34, which increased width region is defined by the slanted or tapering cuts 41. This provides more freedom of movement of the tongue by reducing frictional interference between the tongue and rear bearing members.

The unique spring clip structure 30 described above offers a number of advantages. First, solder is not required to secure the fuse wire 28 to the blades 24. Second, the unique cradle structure 40 of each blade 24, in cooperation with the front bearing tongue 36, provides a self-aligning, clamping engagement which is resistant to failure under vibration loading. In fact, to some extent, vibration of the assembly of the fuse wire blades would tend to promote proper centering of the fuse wire within the apex of the V-shaped cradles 40. That is, if for some reason during manufacture, the fuse wire 28 was displaced from the apex of the "V" and was improperly positioned on one or the other of the two legs of the "V" of the cradle 40, then any vibration would tend to cause the fuse wire 28 to slide along the leg of the "V" to the apex of the "V" wherein the wire 28 would be seated under influence of the opposing pressure of the front bearing tongue 36 in a self-aligning, clamping engagement.

Since solder is not required to make the joint or connection between the fuse wire 28 and the spring clip structure 30 of each blade 24, the clamping engagement effected by the spring clip structure 30 will not be deleteriously affected by heat generated in the fuse wire 28 under normal current carrying conditions or at currents approaching the current rating of the fuse. Although the spring clip structure 30 of a blade 28 may be heated up somewhat, the temperature increase would not be enough to effect the stiffness of the spring clip structure significantly, and would certainly not be enough to destroy the effectiveness of the spring clip clamping action. Obviously, at some very high temperature, the tongue 36 would lose some or all of its elastic, or spring, properties. However, this temperature is much higher than the melting point of the fuse wire 28, and thus that condition could not occur.

The spring clip structure 30 allows fuses to be constructed with precise ratings. As can be seen best in FIG. 2, the fuse wire 28 is in contact with each blade 24 at the inside edge 50 of each blade 24. It is the precise spacing between these two electrical contact points which determines the rating of the fuse for any given wire 28. The spacing between the two side edges 50 of a pair of blades 24 in a given fuse can be precisely controlled during fabrication so that the fuse rating can be precisely determined. This is in contrast to solder-type connections where the mass of deposited solder is irregular and where the actual distance along the fuse wire between the two soldered blade connections cannot be easily predetermined or controlled during fabrication.

Various alloy compositions may be used for the fuse wire 28, depending upon the rating of the fuse. Typically, 95/5 tin lead wire is used. This is fairly soft and may bend slightly under the influence of the spring force of the front bearing tongue 36 pressing the wire 28 against the two V-shaped cradles 40 in each terminal blade 24 on either side of the tongue. By appropriate design, the spring force of the tongue is not high enough to cause the tongue 36 or the V-shaped cradle portions 40 of the terminal blade 24 to cut into the soft fuse wire 28. However, any slight "bending" of the fuse wire between the pair of cradles 40 of a blade 24 does effect an even more secure clamping engagement and is, for that reason, desirable.

For a given fuse wire composition, the diameter of the wire may be varied to obtain differing fuse ratings. The spring clip structure 30 will, for a given size spring clip, accommodate fuse wires of varying diameter. Thus, it is possible that a single blade may be used in a large number of differently rated fuses. This of course promotes a certain economy of manufacture.

The spring clip structure can easily accommodate, and is typically designed to accommodate, fuse wires having a diameter on the order of between 0.010 inches and 0.040 inches. The spring clip structure will typically permit the front bearing member to bend outwardly away from its normal vertical position in alignment with the rear bearing members a distance of about 0.052 inches to accommodate insertion of the 0.040 inch diameter fuse wire. Typically, the blades are made from spring brass which has been found to have the suitable spring characteristics.

The blade structure described above has been illustrated with generally rectangular, male, terminal-forming blades. The blades are intended to be received within an electrical component receiving block having within it pairs of spaced-apart, spring-biased, conducting strips forming female connectors for matingly engaging the blades of the electrical component. It is to be understood, however, that each of the blades of the electrically conducting component may have a terminal-forming portion comprising a pair of spaced-apart, spring-biased, conducting elements or strips forming a female structure which could be connected with a male conducting structure mounted in a suitable receiving block.

When using the above-described electrically conducting three-piece solderless component as a fuse, an encapsulating body is preferably provided around the conducting element and a major portion of the blades. With respect to FIGS. 1 through 3, a fuse 20 has an encapsulating body 22 which is preferably a solid, unitary body of electrically insulating material, such as a thermoplastic, and which is in intimate contact with the external surfaces of the fuse wire 28 and the spring clip portions 30 of each blade 24. As is best illustrated in FIGS. 2 and 3, the body 22 extends over more than half of the length of each blade 24.

The encapsulating body provides a gripping or supporting function with respect to the unique clip structure of the present invention. If the insulating material is a molded thermoplastic, owing to shrinking during cooling after the molding process, the thermoplastic material provides very good support for the spring clip structure.

The body 22 may have a specific configuration required to fit within a fuse block. For example, the unitary body 22 may have two pairs of lower walls, such as end walls 60, slanting corner walls 61, and slanting sidewalls 62. The slanting walls slope inwardly towards the terminal portions of the blades 24 and may be wedged between walls (not shown) of a plug-in fuse block to hold the fuse therein.

Above the walls 60 and 62, the body 22 preferably has a cylindrical structure 66 as best illustrated in FIGS. 1 and 2. The cylindrical structure 66 is generally centrally located with respect to the length of the fuse so that the fuse wire 28 is substantially centered within the cylindrical structure 66. Centering of the fuse wire 28 within the cylindrical structure 66 effects a substantially symmetrical temperature gradient and consequent uniform heat transmission from the center segment of the fuse wire 28 through the cylindrical structure 66 to the surface of the fuse and then into the ambient atmosphere.

The body 22 is preferably made of a clear thermoplastic which can be easily molded about the three-piece fuse wire and blade assembly and which, owing to its transparency, effects an optical magnification of the fuse wire 28 through the generally cylindrical structure 66.

A number of different thermoplastic materials may be used for the body 22. For fuses of relatively low amperage capacity, a rubber-filled thermoplastic such as SAN may be used. For fuses having higher amperage capacities, a polycarbonate thermoplastic, such as LEXAN, may be used. For fuses with still higher amperage ratings, a thermoplastic that is more resistant to high temperatures, such as the high-temperature type of nylon, may be used.

Though it is preferable that the cylindrical portion 66 be made of a transparent thermoplastic to allow visual examination of the condition of the fuse wire 28 therein, it may also be desirable to add a pigment, surface coating or frosting to the remaining exterior portions, or parts of the remaining exterior portions, of the body 22. Further, apertures such as at 70, may be provided in one or more of the side surfaces 62 to allow insertion of a conventional electrical test probe (not shown) for contacting the blades 24 of the fuse to test the continuity of the fuse while it is plugged into a fuse block.

As illustrated in FIG. 1, a roughened or knurled gripping surface 72 may be provided on the upper exterior portions of the body 22 to permit one to better grip the fuse during insertion into, or removal from, a fuse receiving block. Preferably, the knurled surfaces 72 are located on either side of the generally cylindrical magnification structure 66. Additionally, various indicia such as at 74 and 76 may be provided on various exterior portions of the body 22 to indicate the electrical ratings, manufacturer's insignia and the like.

The use of a totally encapsulated body of insulating material surrounding the fuse element serves to contain the electrical arc generated when the fuse blows. Since the arc is not then in communication with the ambient atmosphere, it is impossible for the fuse, upon blowing, to ignite any combustible vapors which may be in the ambient atmosphere. Thus, the structure provides a fuse which is essentially non-explosive and therefore desirable for use in automobiles, airplanes, ships and the like, as well as in stationary industrial applications where explosive vapors are a problem.

The encapsulated, three-piece solderless plug-in electrically conducted component or fuse described above and illustrated in FIGS. 1 and 2 can be made with a novel apparatus according to the method of the present invention as will next be described.

Figure 4:
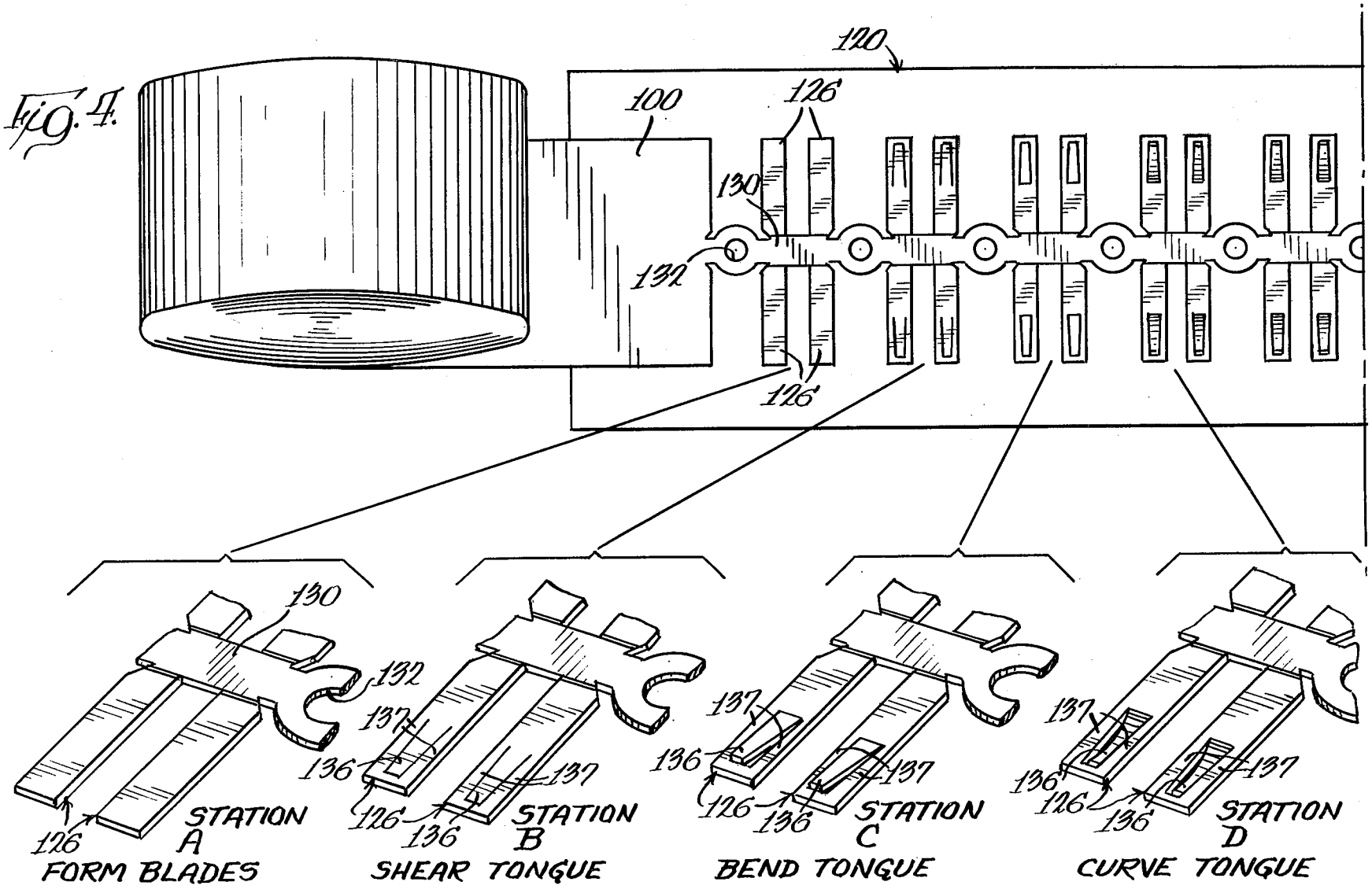
FIG. 4 is a diagrammatic illustration of the sequence of formation, in a strip of metal being unwound from a supply coil, of the blades of the fuse according to the method of the present invention.
Figure 5:
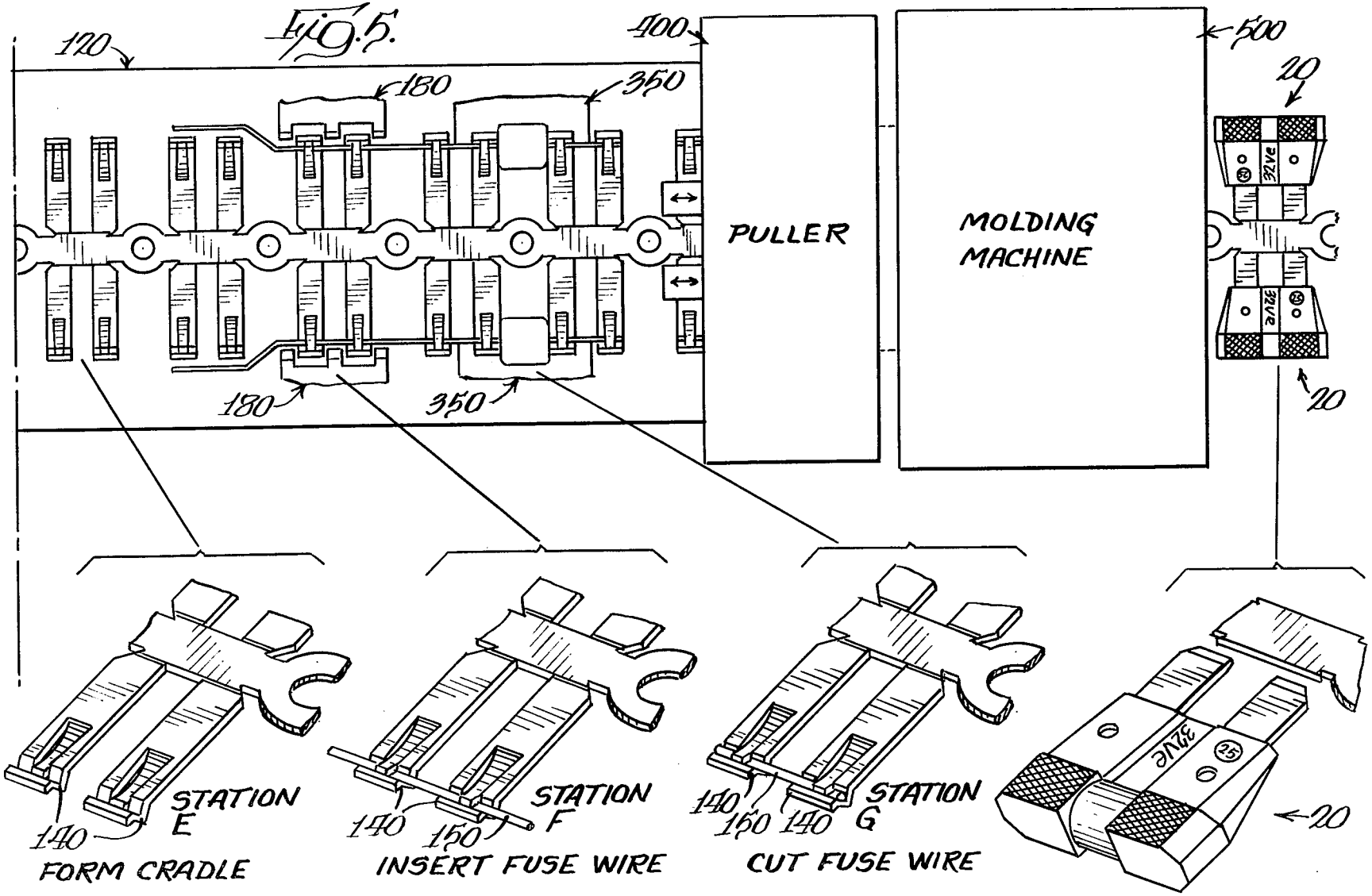
FIG. 5 is a continuation of FIG. 4 diagrammatically illustrating the method of inserting a fuse link into the blades, pulling the strip of blades along a path, and encapsulating the blades with a unitary body of insulating material in a molding machine.

FIGS. 4 and 5 are diagrammatic illustrations of the method of the present invention as executed by the apparatus of the present invention. FIG. 4 shows the left-hand half of the apparatus and FIG. 5 shows the right-hand half of the apparatus. The apparatus operates to form a metal component in a series of steps progressing from left to right in FIGS. 4 and 5.

In general, the component is formed from sheet metal stock unreeled from a coil of strip metal or sheet stock 100 mounted by suitable means, such as a spool (not illustrated), at one end of the apparatus. The metal 100 is formed by a progressive stamping die 120 as it is pulled from the coil by a puller mechanism 400 located downstream of the stamping die 120 (FIG. 5). When the three-piece metal structure is finally completed with the wire clamped between the two spaced-apart parallel blades, the structure is placed in the suitable molding apparatus 500 (FIG. 5) wherein a portion of the structure is encapsulated with a solid, unitary body of an electrically insulating material to form the completed component, such as the fuse 20 previously described with respect to FIGS. 1 through 3.

The progressive stamping die 120 is only diagrammatically illustrated in the figures and has a plurality of stations (labeled A through G in FIGS. 4 and 5) spaced along its length between the coil of metal 100 and the puller device 400. Each station effects a certain blanking, cutting, forming, etc. operation on the strip of metal 100.

Each station A through G may include one or more individual stamping dies (which are understood to necessarily include cooperating punches). For reasons of clarity, only two dies 350 are illustrated at Station G in FIG. 5. These dies can have any configuration suitable for effecting the specific alteration of the metal strip that is required. The details of the construction of such stamping dies are well-known to those skilled in the art and therefore no further description of the die configuration will be given.

At Station A illustrated in FIG. 4, a stamping operation occurs which includes the stamping of the basic form of pairs of spaced-apart blades 126 into of mtal 100. As illustrated, it may be desirable to form two pairs of blades 126, with each pair remaining connected to a center carrier member 130 remaining when the strip is stamped to form the pairs of blades. The two pairs of blades 126 extend in opposite directions from carrier member 130 and are connected to the carrier member 130 at the terminal portions of the individual blades.

Guiding apertures 132 may be simultaneously stamped in the carrier member 130 and these guiding apertures 132 can receive guide pins projecting upwardly from the bottom portions of the progressive stamping die 120. This assures proper alignment of the carrier member and attached blades at each station. Although the configuration illustrated at Station A is preferably formed in one pair of dies, various portions of the configuration could be separately stamped at other stations either before or after Station A if desired.

The carrier member 130 and the projecting blades 126 are moved to the next station, Station B, by the puller 400. Preferably, the carrier member 130 and blades 126 are spring-biased upwardly away from a lower or base portion of the progressive stamping apparatus 120 after the individual stamping punches and dies have been operated at each station. This will allow the carrier and blades to disengage from the lower halves of the dies and from any guide pins (such as those that may project upwardly through the apertures 132) so that the puller 400 can pull the structure to the next stations and so that the scrap can be removed. The use of stamping dies having upper and lower halves in a progressive die apparatus with an upwardly spring-biased workpiece is known in the stamping art and details of such a construction need not be given here.

The puller apparatus 400 may be of a conventional type, such as an air-operated material feeder, mounted so as to pull, rather than push, the strip 100 through the progressive stamping die 120.

At Station B, the blades 126 are sheared to form the basic configuration of the tongues 136 which will later be formed into a shape identical to tongue 36 in FIGS. 1 through 3. The regions of the blades on either side of each tongue 136 are the blanks of the rear bearing members 137 corresponding to the members 34 in the completed fuse illustrated in FIGS. 1 through 3.

At Station C, each tongue 136 is bent upwardly at a slight angle and at Station D each tongue is formed into an arcuate configuration with the distal end of the tongue projecting upwardly and generally in alignment with the distal ends of the rear bearing members.

At Station E, V-shaped cradles 140 are formed near the ends of the rear bearing members 137. These cradles 140 correspond to the cradles 40 illustrated in FIGS. 1 through 3 and described above.

At Station F a fuse wire 150 is inserted into the blades and at Station G the fuse wire is severed from each side of a pair of blades. The novel method for inserting fuse wire 150 into the blades at Station F will next be described in detail with reference to FIGS. 6 through 10.

The fuse wire 150 is provided in a continuous length along each side of the progressive stamping die 120 adjacent the outwardly projecting blades. The wire 150 is preferably unreeled from a spool (not illustrated) and is guided through a wire insertion mechanism designated generally as numeral 180 in FIGS. 5 and 6.

Figure 7:
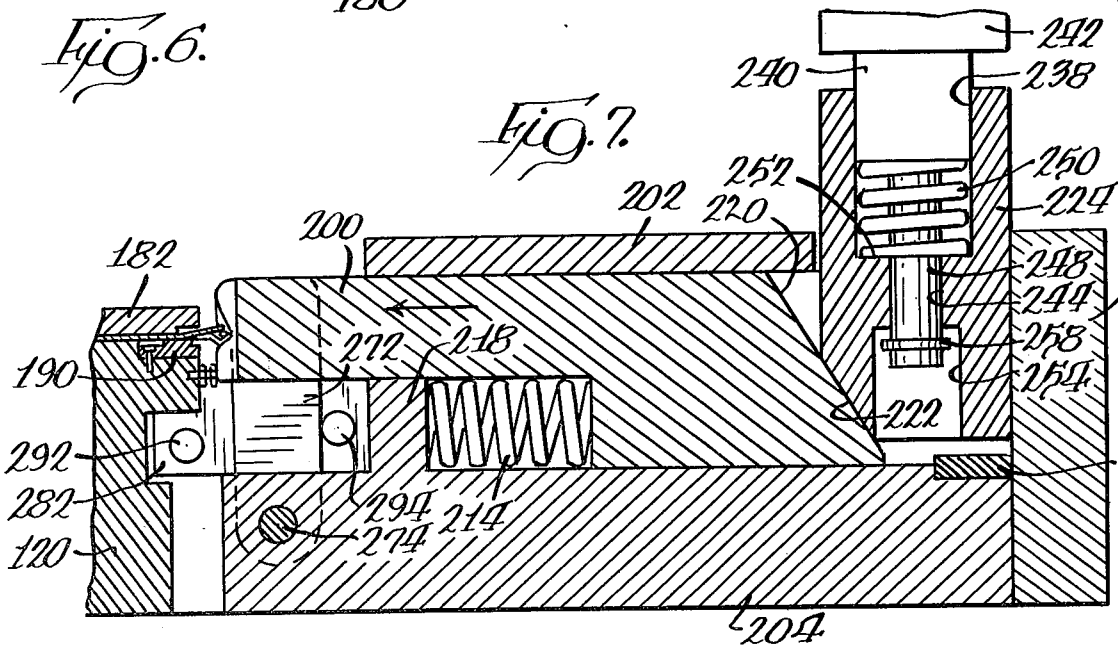
FIG. 7 is a cross-sectional view taken generally along the plane 7—7 of FIG. 6.
Figure 8:
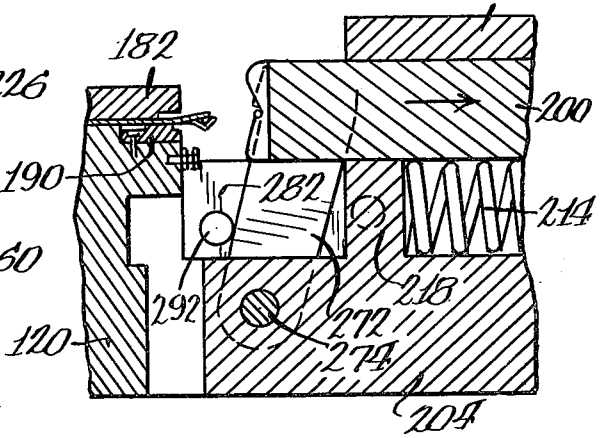
FIG. 8 is a view similar to FIG. 7, but reduced in scale, and illustrating the retraction of the wire insertion mechanism from the blade region.
Figure 9:
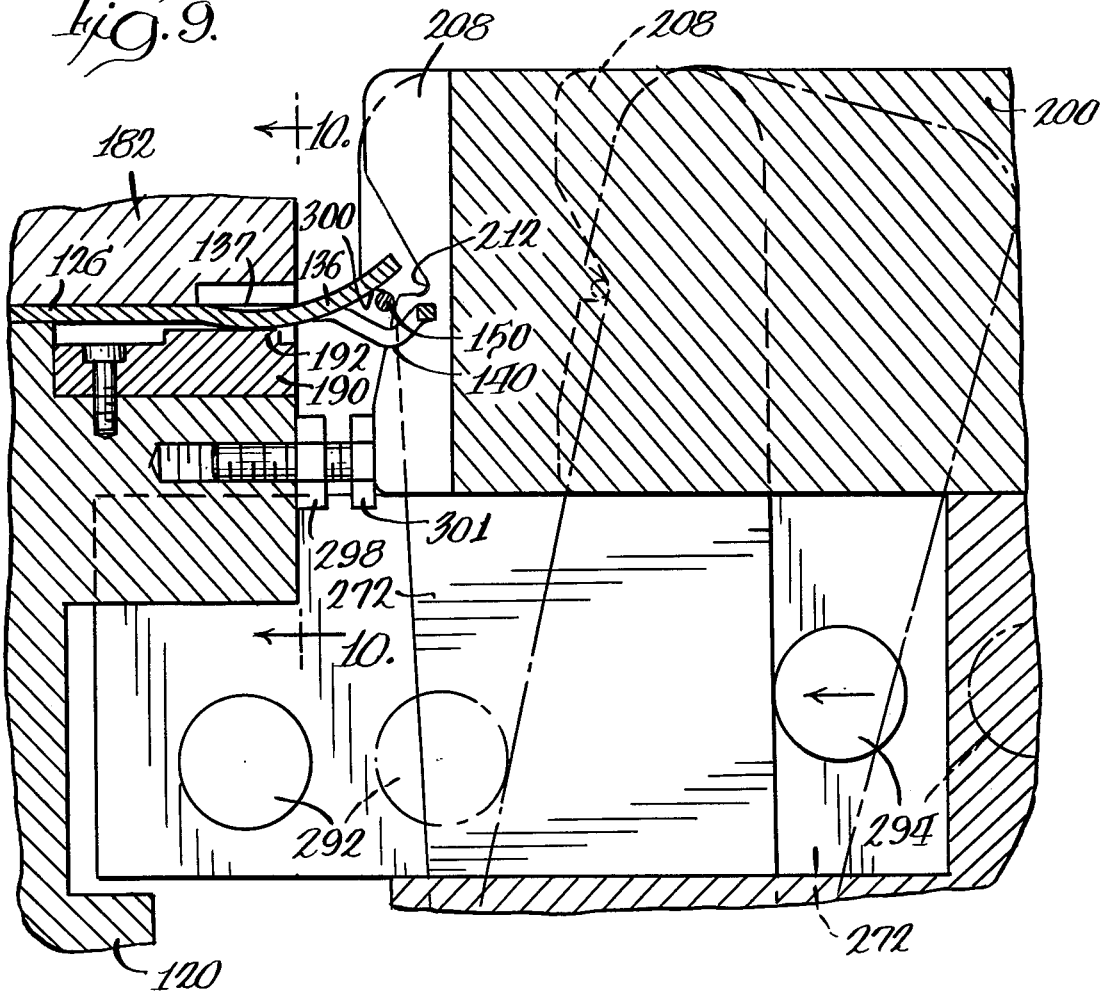
FIG. 9 is an enlarged cross-sectional view similar to FIGS. 7 and 8 wherein the dashed lines indicate the moved position of a portion of the apparatus as illustrated in FIG. 8.
Figure 10:
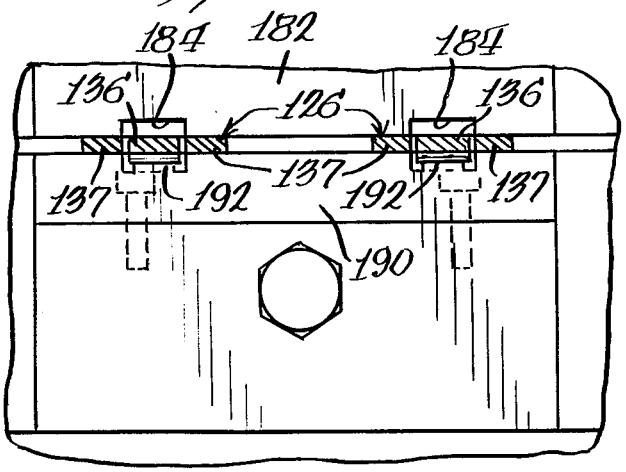
FIG. 10 is a side view taken generally along the plane 10—10 of FIG. 9.

As best illustrated in FIGS. 7, 8, and 9, an upper bearing plate 182 is associated with the progressive stamping die 120 and is provided to overlie the blades 126 in Station F. The upper bearing plate 182 is movable upwardly and downwardly with the upper halves of the individual stamping dies between a raised position spaced away from the blades 126 and a lowered position bearing downwardly against the blades. As clearly illustrated in FIG. 10, the upper bearing plate 182 has recesses 184 for receiving a portion of the tongue 136 when it is deflected upwardly as will be explained in more detail hereinafter.

As best illustrated in FIG. 9 a removable insert 190 is mounted to the progressive stamping die 120 under the blades and has an upwardly projecting pad 192 spaced inwardly of the rear bearing members 137. The pad 192 is adapted to contact the downwardly curving portion of the tongue 136.

When the upper bearing plate 182 is brought downwardly against the blades 126, the downwardly curving portion of each tongue 136 is forced upwardly by the pad 192 to provide an opening between the distal end of the front bearing tongue and the cradles of the rear bearing members. Of course, if desired, the progressive stamping die could be operated with the upper halves of the die members and the upper bearing plate 182 fixed against vertical movement and then moving the lower halves of the die members and the insert 190 upwardly to effect the various metal forming operations and cause the tongue 136 to open.

The continuous fuse wire 150 is inserted into the opening between the tongue 136 and the cradles 140 of the rear bearing members 137 by the insertion device 180. The insertion device 180 has a central ram 200 slidably received between a top frame member 202, a bottom frame member 204 and opposed side frame members 228 and 230.

The ram 200 has three spaced apart projections or fingers 206, 208 and 210. Each finger has a notch or shoulder, such as shoulder 212 in finger 208 illustrated in FIG. 9. The shoulders are adapted to receive the continuous fuse wire 150.

The ram 200 is spring-biased rearwardly away from the blades by a spring 214 compressed between the ram 200 on one end and an upstanding wall portion 218 of the frame 204 on the other end. The ram 200 has a rear inclined surface 220 adapted to slidably contact an opposed inclined surface 222 on a plunger block 224. The plunger block 224 is vertically reciprocable within a rectangular-shaped opening defined on one side by the top frame member 202, on the opposite side by an upstanding vertical frame member 226, and on the other two opposed sides by side frame members 228 and 230. The rear frame member 226 is secured, as by screws 232 and 234 to the side frame member 228 and 230, respectively.

Block 224 has an upper cylindrical bore 238 for receiving a cylindrical rod 240 extending from a hydraulic cylinder/piston actuator 242. The block 224 has an additional bore 244 generally coaxial with the upper bore 238 but smaller in diameter than the upper bore. The smaller bore 244 receives a guide pin 248 connected with, and projecting downwardly from, the rod 240. A spring 250 is disposed around the guide pin 248 within the large bore 238 and is compressed at one end by the rod 240 and at the other end by an annular shoulder surface 252 formed within the block 224 at the bottom of the upper bore 238.

At the bottom end of the block 224 a third bore 254 is provided for receiving the distal end of the guide pin 248. A retaining ring 258 is preferably provided on the distal end of the guide pin 248 within the third bore 254. The retaining ring 258 has an outside diameter greater than the diameter of the second bore 244 in the block 224.

Operation of the actuator 242 to move the rod 240 downwardly acts through the partially compressed spring 250 to force the block 224 downwardly against the ram 218. Owing to the contacting, slanting surfaces 222 and 220 of the block 224 and the ram 200, respectively, the ram 200 is urged outwardly, or to the left as viewed in FIG. 7, against the spring 214.

The downward movement of the block 224 may be limited by an insert block 260. By using different size blocks 260, the maximum downward movement of block 224, and hence the maximum outward movement of the ram 200, can be changed. When the block 224 hits the insert block 260, shocking the actuator 242 is prevented by the spring 250 which then undergoes further compression owing to any continued downward movement of the actuator rod 240.

Release of the downward force on the actuator rod 240 by the actuator 242 permits the compressed spring 214 to move the ram 200 rearwardly and retract it from the blades 126.

Figure 6:
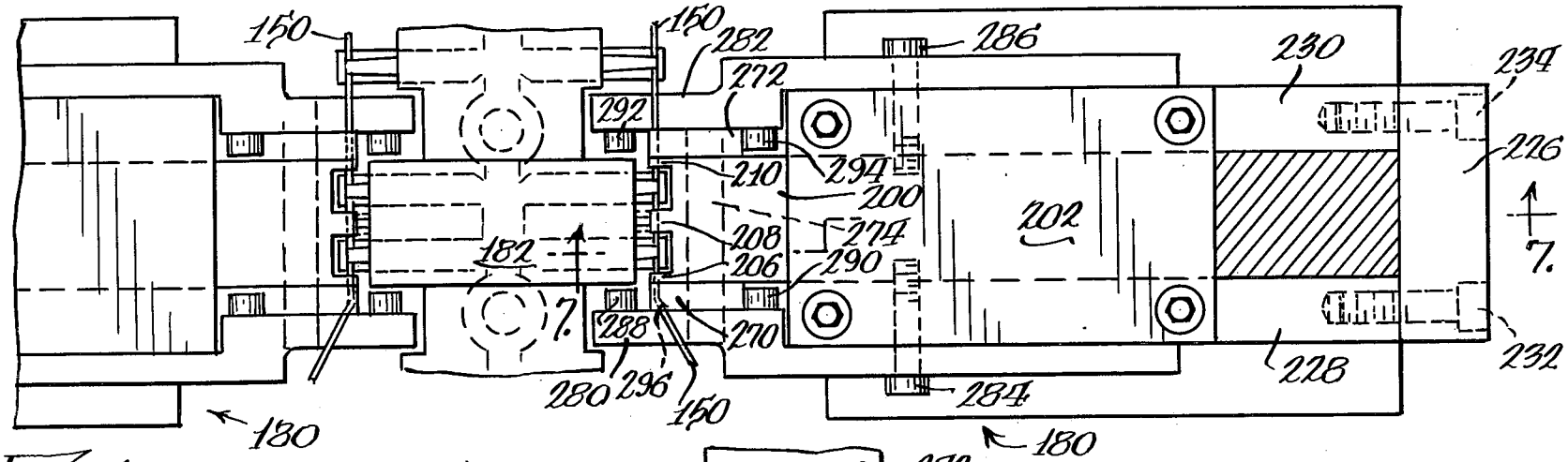
FIG. 6 is a plan view of a portion of the apparatus of the present invention illustrating the insertion of the fuse link wire into the spring clip structure of the fuse blades.

As illustrated in FIG. 6, a separate pair of pivotable arms 270 and 272 are provided on either side of the ram 200. Each arm 270 and 272 is mounted about a shaft 274 retained within the lower frame member 204.

A side guide member 280 is provided on the outside of the pivot arm 270 and a side guide member 282 is provided on the outside of pivot arm 272. Each side guide 280 and 282 is secured to the ram 200 as by bolt 284 for side guide 280 and by bolt 286 for side guide 282. Thus, the side guides 280 and 282 move together as a unit with the ram 200.

Side guide 280 has a pair of inwardly projecting pins 288 and 290 and side guide 282 has a pin of inwardly projecting pins 292 and 294. With reference to FIGS. 7 and 9, the pins 292 and 294 are seen to project inwardly from the side guide 282, one pin on each side of the pivot arm 272.

Thus, as the ram 200 is moved forward, to the left as viewed in FIGS. 7, 8, and 9, the pin 294 contacts the arm 272 and pivots it forward (counterclockwise about the shaft 274). Conversely, as the ram 200 is retracted rearwardly, to the right as viewed in FIGS. 7, 8 and 9, pin 292 eventually contacts the arm 272 and swings the arm 272 in a clockwise direction about the shaft 274 to the fully retracted position shown by dashed lines in FIG. 9.

The arms 270 and 272 each have a notch or shoulder, such as shoulder 300 for arm 272 illustrated in FIG. 9, which shoulder 300 is generally oppositely facing from the shoulders in the projections 206, 208, and 210 of the ram 200. The continuous fuse wire 150 is thus retained across the face of the wire insertion apparatus 180 intermittently along its length by the shoulders in the pivot arms 270 and 272 and by the oppositely facing shoulders in the projections of the ram 200.

In operation, the ram is pushed forward by actuator 242 as was previously explained in detail. Forward movement of the ram 200 causes the pivot arms 270 and 272 to also move forward. However, owing to the pivot arrangement about shaft 274, the ends of the arms 270 and 272 move at a greater speed than the ram 200. Consequently, as illustrated in FIG. 9, when the forward motion of the ram has terminated, the pivot arm have been moved forwardly a small amount beyond, and relative to, the ram 200. The pivot arm shoulders, such as shoulder 300 of pivot arm 272, thus force the continuous fuse wire 150 off of the shoulder 212 of the ram 200. The wire 150 is moved downwardly along the front of the ram 200 by the arms 270 and 272 into the opening between the distal end of the tongue 136 and the blade cradle portions 140.

After the fuse wire 150 has been seated within the cradles 140, the wire insertion apparatus actuator 242 is released to allow the spring 214 to retract the ram 200 along with pivot arms 270 and 272.

When the wire insertion apparatus 180 has been fully retracted, the upper bearing plate 182, along with the upper halves of the individual stamping dies at the other stations in the progressive stamping die 120, are raised upwardly away from the blades. With a release of the force on the blades, the tongue 136 springs back downwardly to securely clamp the fuse wire 150 against the cradles 140 in each blade.

Next, the stamped workpiece strip of metal 100, having been formed into blades with the wire inserted, is raised off of the lower dies and pulled to the next station, Station G. Here a cutter die 350 is provided (FIG. 5). The cutter die 350 has a suitable configuration for severing the wires between adjacent pairs of baldes. Dies for cutting wires between adjacent pairs of articles are well known to those skilled in the art and no further description of them will be given here.

The strip of completed blade structures, with the fuse wires appropriately clamped, exit from the puller device 400 still attached to the carrier member 130. A convenient length of the strip of completed structures may be severed by some suitable apparatus (not shown), and then inserted into a conventional molding apparatus so that a plurality of electrically conducting components may be encapsulated at one time. Such a process is schematically illustrated in FIG. 5 wherein two completed fuses 20 are shown exiting from the molding machine. The completed, encapsulated components may be shipped and sold while still attached to the carrier member 130 or they may be severed from the carrier member 130 as soon as they are discharged from the molding machine.

It is to be noted that the novel wire insertion system of the present method permits automatic de-reeling of the fuse wire alongside the progressive die mold. To this end, it is desirable to outwardly angle or bevel the shoulder in upstream pivot arm 270 as at numeral 296 in FIG. 6 in order to avoid putting a sharp bend in the wire.

It is to be noted that with the novel method and apparatus of the present invention, different diameter fuse wires can be inserted automatically into the blades. To this end, the insert 190 below the tongue 136 (FIG. 9) may be removed and a different insert, having a higher or lower pad 192, may be substituted. This will cause the tongue 136 to open to a greater or lesser degree, respectively.

It is preferable to cause the tongue 136 to be bent upwardly about its bend line or hinge point to cause some amount of plastic deformation so that the tongue 136 will not return completely to its pre-stressed position if the wire 150 is removed. This prevents undue clamping force on the wire 150 which, with small diameter wires, might tend to sever them in the blade cradles. The amount of plastic deformation, and hence the amount of upward bending of the tongue 136 during the tongue opening process, depends on the diameter of the wire that is being inserted into the blades. Consequently, use of a removable insert 190 is an efficient method for accommodating various size wires within the parameters of allowed tongue clamping forces.

It is desirable, under some circumstances, to vary the distance between the blade cradles 140 and the further extension of the wire insertion ram 200. For example, different diameter wires will require slightly different insertion locations with respect to the blade cradles. To this end, an adjustable stop, comprising a bolt 301 and nut 298, is provided on the lower portion of the progressive stamping die 120 as illustrated in FIG. 9. The adjustment of the outward displacement of the bolt 300 will ensure that the ram 208 cannot travel beyond the point where it contacts the bolt 301. To the extent that it is desired to use the stop bolt 301 exclusively, insert stop block 260 (FIG. 7) may be eliminated altogether.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. The method of making an encapsulated, three-piece solderless plug-in fuse comprising the steps of:

providing a pair of blades, each blade having at one end a terminal portion for being connected into an electrical circuit and at the other end a fusible link support spring clip;

arranging said blades in spaced-apart, generally parallel relationship;

inserting a fusible link into the spring clip of each of said pair of blades; and encapsulating said fusible link and the fusible link support spring clip of each of said blades with a solid unitary body of electrically insulating material so that the external surfaces of said link and said blade spring clip portions are in intimate contact with said material.

2. The method of claim 1 including the further step of forming said body with two pairs of walls, at least one of the pairs of walls slanting inwardly towards the terminal portions of said blades whereby the slanting walls may be wedged between the end walls of a plug-in fuse block to hold the fuse therein.

3. The method of making a three-piece solderless plug-in fuse element comprising the steps of:

providing a pair of blades, each blade having at one end a terminal portion for being connected into an electrical circuit and at the other end a fusible link support spring clip;

arranging said blades in spaced-apart, generally parallel relationship; and aligning a fusible link substantially perpendicular to each blade and inserting in into the spring clip of each blade to provide a solderless electrically conductive path from one of said blades through the fusible link to the terminal portion of the other end of said blades.

4. The method of making an encapsulated three-piece solderless plug-in electrically conducting component comprising the steps of:

providing an elongate conducting element and at least two blades, each said blade having at one end a terminal portion for being connected into an electrical circuit and at the other end a conducting element support spring clip;

arranging said blades in spaced-apart, generally parallel relationship;

aligning said conducting element substantially perpendicular to said blades;

clamping said conducting element at spaced locations along its length to said spring clips of each blade; and encapsulating said conducting element and the conducting element support spring clip portion of each of said blades with a solid unitary body of electrically insulating material so that the external surfaces of said element and said blade spring clip portions are in intimate contact with said material.

5. The method of making an encapsulated, three-piece solderless plug-in fuse comprising the steps of:

providing a pair of metal blades and a substantially cylindrical fuse wire, each blade having at one end a terminal portion for being connected into an electrical circuit and at the other end a pair of spaced-apart rear bearing members and a flexibly hinged front bearing tongue between said rear bearing members, each of said rear bearing members having a cradle with a substantially V-shaped cross section for receiving a portion of said fuse wire;

arranging said blades in spaced-apart, generally parallel relationship;

aligning said fuse wire substantially perpendicular to said blades;

bending said tongue away from said pair of rear bearing members in each blade to provide an opening between said tongue and said pair of rear bearing members;

inserting said fuse wire through said opening into said cradle of each of said rear bearing members;

releasing said tongue in each blade against said fuse wire whereby said fuse wire is clamped in self-aligning, vibration resistant engagement between said front bearing tongue and said pair of rear bearing members to provide a solderless electrically conductive path from one of said blades through the fuse wire to the terminal portion of the other of said blades; and encapsulating said fuse wire and a portion of each of said blades with a solid unitary body of electrically insulating transparent thermoplastic material so that the external surfaces of said wire and said bearing members and bearing tongue are in intimate contact with said material.

6. The method of claim 5 wherein the step of encapsulating includes encapsulating each of said blades for at least half of the length of each blade.

7. The method of claim 5 wherein the step of providing a pair of blades and a fuse wire includes stamping said rear bearing members and said tongue for each blade from a single piece of metal.

8. The method of making a three-piece electrically conducting component comprising the steps of:

(a) forming at least one pair of spaced-apart blades in a sheet stock of electrically conducting metal, each blade having at one end a terminal portion for being connected into an electrical circuit and at the other end a pair of spaced-apart rear bearing members and a flexibly hinged front bearing tongue between said rear bearing members, each of said rear bearing members having a cradle with a substantially concave cross section for receiving a wire therein;

(b) forcing said hinged front bearing tongue outwardly away from said rear bearing members of each blade to provide an opening between the distal end of said front bearing tongue and the cradles of said rear bearing members;

(c) inserting a wire into said opening between the distal end of said front bearing tongue and the cradles of said rear bearing members in each blade so that the wire segment extends across the space between the blades;

(d) relieving the force applied in step (b) to permit said front bearing tongue to move back toward said rear bearing members and force said wire segment against said cradles of said rear bearing members whereby the wire is securely clamped between the pairs of metal blades.

9. The method in accordance with claim 8 including the further step of encapsulating said wire and a portion of each of said blades with a solid unitary body of electrically insulating material so that the external surfaces of said wire, said bearing members, and said bearing tongue are in intimate contact with said material thereby forming an encapsulated, three-piece electrically conducting component which can function as a solderless plug-in fuse.

10. The method in accordance with claim 8 in which step (a) includes the steps of providing said sheet metal stock in the form of a coil of metal and pulling said stock to unreel said stock from said coil.

11. The method in accordance with claim 8 in which the step (b) of forcing said tongue outwardly from said rear bearing members includes forcing said tongue abouts its hinge a predetermined amount beyond the elastic limit of the material.

12. The method in accordance with claim 8 further including, after step (d), the step of providing a molding apparatus at one end of said progressive stamping die and further including the step of molding a solid unitary body of electrically insulating material around said wire and portions of said blades so that the external surfaces of said wire and said tongue and rear bearing members are in intimate contact with said material thereby forming an encapsulated, three-piece electrically conducting component which can function as a solderless plug-in fuse.

13. The method in accordance with claim 8 in which step (a) includes the step of providing a progressive stamping die having a plurality of metal forming stations and moving said strip of material through said die in intermittent movements so that a region of said strip is progressively located at each station.

14. The method in accordance with claim 13 in which step (a) includes the steps of forming said pair of metal blades at one station, forming said tongues and rear bearing members in said blades at a subsequent station, and forming said cradles in said rear bearing members at a subsequent station.

15. The method in accordance with claim 13 in which said step (a) of forming at least one pair of blades includes the step of forming two pairs of blades from said strip of metal with each of the two pairs of blades left connected to a center carrier member of said strip, said pairs of blades extending in opposite directions from said carrier member and being connected to said carrier member at said terminal portions of said blades.

16. The method in accordance with claim 13 in which said progressive stamping die includes (1) a tongue opening insert having a projecting pad on one side for abutting one side of said tongue and (2) a plate having a recess for confronting the other side of said tongue and wherein said step (c) of inserting said wire includes forcing said blades towards said pad whereby said tongue is forced against said pad and flexes upwardly and away from said cradles of said rear bearing members to provide an opening for receiving said wire.

17. The method in accordance with claim 16 in which the step (c) of inserting said wire includes the steps of providing a continuous length of wire along the side of said progressive stamping die and outwardly of the distal ends of said tongue and said rear bearing members and moving a portion of said continuous wire inwardly into the opening between said outwardly forced tongue and said rear bearing members.

18. The method in accordance with claim 17 further including, after step (d), the step of severing said continuous length of wire upstream of said pair of metal blades.

19. The method in accordance with claim 17 in which step (c) includes the steps of (1) providing at least two adjacent, relatively movable wire carrying members, each member having a shoulder for engaging said continuous wire thereon, the shoulders of each member being oppositely facing; (2) moving both wire carrying members against said continuous wire to force said continuous wire toward said opening between said tongue and said rear bearing members; and (3) moving one of said two wire carrying members closer to said opening than the other to force said continuous wire off of the shoulder of said other wire carrying member and into said cradles of said rear bearing members.

20. An apparatus for making a three-piece electrically conducting component having one pair of spaced-apart blades with a wire clamped across said blades between rear bearing members and a flexibly hinged front bearing tongue, said apparatus comprising:

a progressive die having a plurality of stations wherein a strip of metal is moved through said die from station to station, and having punch and die means in at least one of said stations for forming said spaced apart pair of blades with said rear bearing members and said tongue formed therein;

a wire insertion station in said progressive die having a lower projecting pad and an upper movable plate generally parallel to and spaced from said projecting pad, said plate and pad adapted to receive a pair of said spaced apart blades therebetween, said pad being adapted to project between the rear bearing members of each blade and contact a portion of said tongue when said upper plate is moved downwardly to force said blades downwardly and thereby force said tongue against said pad upwardly away from said rear bearing members to form a wire receiving opening therebetween; and means for inserting said wire into said opening in each blade of each said pair of blades, said means including at least a first wire carrying member and a second wire carrying member adjacent said progressive die at said wire insertion station, said first and second members being movable generally perpendicular to the direction of travel of said metal strip through said progressive stamping die, said first member having a wire receiving shoulder and said second member having a wire receiving shoulder oriented generally oppositely facing from said shoulder of said first wire carrying member, said wire inserting means further including means for moving said first member towards said wire insertion station to a predetermined distance therefrom and means for moving said second member towards said wire insertion station to a second predetermined distance therefrom which is less than said first predetermined distance whereby the shoulder of said second member moves the wire off of the shoulder of said first member and into the opening of said blades.

* * * * *

UNITED STATES PATENT AND TRADEMARK OFFICE

CERTIFICATE OF CORRECTION

PATENT NO. : 4,203,200

DATED : May 20, 1980

INVENTOR(S) : Gerald L. Wiebe

It is certified that error appears in the above-identified patent and that said Letters Patent are hereby corrected as shown below:

Column 3, line 68, "μ" should be --3/4--.

Column 4, line 1, "μ" should be --3/4--.

Column 8, line 63, "into of mtal" should be --into a strip of metal--.

Column 12, line 20, "baldes" should be --blades--.

Signed and Sealed this

*Twenty-third* Day of *September 1980*

[SEAL]

*Attest:*

SIDNEY A. DIAMOND

*Attesting Officer*

*Commissioner of Patents and Trademark*